US012357047B2

(12) United States Patent
Strohmeier

(10) Patent No.: US 12,357,047 B2
(45) Date of Patent: Jul. 15, 2025

(54) TEXTILE LAYERED CONSTRUCTION

(71) Applicant: Mammut Sports Group AG, Seon (CH)

(72) Inventor: Josef Strohmeier, Hendschiken (CH)

(73) Assignee: Mario Julen Holding AG, Zermatt (CH)

( * ) Notice: Subject to any disclaimer, the term of this patent is extended or adjusted under 35 U.S.C. 154(b) by 946 days.

(21) Appl. No.: 17/156,752

(22) Filed: Jan. 25, 2021

(65) Prior Publication Data

US 2021/0137191 A1 May 13, 2021

Related U.S. Application Data

(63) Continuation-in-part of application No. PCT/EP2019/069386, filed on Jul. 18, 2019.

(30) Foreign Application Priority Data

Jul. 23, 2018 (CH) ..... 00903/18

(51) Int. Cl.
*A41D 27/24* (2006.01)
*A41D 31/02* (2019.01)

(52) U.S. Cl.
CPC ..... *A41D 27/245* (2013.01); *A41D 31/02* (2013.01); *A41D 2300/322* (2013.01); *A41D 2300/52* (2013.01); *Y10T 428/198* (2015.01); *Y10T 428/234* (2015.01); *Y10T 428/24826* (2015.01); *Y10T 442/674* (2015.04)

(58) Field of Classification Search
None
See application file for complete search history.

(56) References Cited

U.S. PATENT DOCUMENTS

| | | | |
|---|---|---|---|
| 11,332,854 | B2 | 5/2022 | Koeckritz et al. |
| 2005/0159056 | A1 | 7/2005 | Lap et al. |
| 2005/0188466 | A1 | 9/2005 | Brun et al. |
| 2007/0212537 | A1 | 9/2007 | Seeger et al. |
| 2013/0177731 | A1 | 7/2013 | Moriarty |
| 2014/0363636 | A1 | 12/2014 | Gubler et al. |
| 2016/0295933 | A1 | 10/2016 | Herbener et al. |
| 2017/0172240 | A1* | 6/2017 | Massey ..... B32B 5/26 |

FOREIGN PATENT DOCUMENTS

| | | | |
|---|---|---|---|
| CN | 2838330 | Y | 11/2006 |
| CN | 103847937 | A | 6/2014 |
| CN | 103958195 | A | 7/2014 |
| CN | 105378177 | A | 3/2016 |
| CN | 106037097 | A | 10/2016 |
| CN | 206025301 | U | 3/2017 |
| DE | 10158016 | C1 | 1/2003 |

(Continued)

*Primary Examiner* — Arti Singh-Pandey
(74) *Attorney, Agent, or Firm* — The Webb Law Firm

(57) ABSTRACT

A textile layered construction has a textile outer layer, a textile inner layer and an absorbing component, whereby line-shaped connections between the outer layer and the inner layer are designed as a laser welded joint, forming chambers fillable with insulating material between the welded joints. At least one line-shaped welded joint connection includes an interruption separating the line-shaped welded joint connection into two line-shaped welded joint connection parts.

15 Claims, 11 Drawing Sheets

(56) References Cited

FOREIGN PATENT DOCUMENTS

| | | | |
|---|---|---|---|
| EP | 1785260 | A2 | 5/2007 |
| EP | 2810772 | A1 | 12/2014 |
| EP | 3098060 | A1 | 11/2016 |
| EP | 3155933 | A1 | 4/2017 |
| WO | 03013313 | A1 | 2/2003 |
| WO | 2012115413 | A2 | 8/2012 |
| WO | 2013071419 | A1 | 5/2013 |

* cited by examiner

TEXTILE LAYERED CONSTRUCTION

CROSS-REFERENCE TO RELATED APPLICATIONS

This application is a Continuation-In-Part of International Application No. PCT/EP2019/069386 filed Jul. 18, 2019, and claims priority to Swiss Patent Application No. 00903/18 filed Jul. 23, 2018, the disclosures of which are hereby incorporated by reference in their entirety.

BACKGROUND OF THE INVENTION

Field of the Invention

The present invention relates to a textile layered construction with a textile outer layer and a textile inner layer, whereby line-shaped connections between the outer layer and the inner layer are designed as a welded joint so that chambers fillable with insulating material are formed between the welded joints.

Description of Related Art

WO 2012/115413 A2 shows a waterproof down jacket with the characteristics of the preamble of claim 1, in which the seams, with which chambers formed from layers of polyurethane material and filled with down are formed by the polyurethane material layers welded together by the application of heat.

EP 1 785 260 A2 describes the joining of two or more layers for a medical bag, in which at least one outer layer is transparent and non-absorbent for certain laser light and a middle layer heats up when exposed to such laser light and joins with an adjacent layer. In particular, an absorbent layer may also be only partially between the outer layers.

EP 2 810 772 A1 describes the joining of an outer textile sheet with a thin breathable layer underneath, which is laser-welded to the textile sheet, in particular at certain points, wherein a colour change of the outer textile ply leads to the temperature rise at these certain points.

US 2013/0177731 A1 discloses a thermally insulating material for the production of waterproof garments with a layer of pockets filled with insulating material, which are covered on the outside by a water-repellent material. To enhance the insulating effect, a pattern of intersecting seam lines is provided to separate the pockets filled with insulating material between two plastic films.

EP 3 155 933 A1 discloses an air core with air chambers formed from an airtight, water vapour permeable envelope, the envelope of each air chamber being welded in a circumferential joining zone. The envelope consists of an outer textile layer and an inner membrane, both made of thermoplastic polyesters, which are welded together with laser light and under pressure, whereby at least the outer textile layer is transparent and there is a laser light absorbing middle layer between textile layer and membrane.

WO 03/013313 shows an air mattress whose chambers can also be filled with down. Adjacent chambers are separated by a web layer connecting the outer and inner covers, which is welded to the outer and inner covers.

US 2005/0159056 A describes a textile structure similar to WO 03/013313 for jackets, sleeping bags, etc. whereby various visible and non-visible seam techniques are disclosed for the bar layer.

EP 3 098 060 A describes the connection of two substrates to form a laminate.

DE 101 58 016 C1 refers to a process for producing a fluid-tight connection of material layers, in particular of textile fabrics, in which an adhesive layer consisting of an additional sealing strip which seals the material layers or at least one of the material layers is melted by means of a laser beam. The sealing strip and the material layer are then joined to the material layers or the other material layer.

SUMMARY OF THE INVENTION

According to this prior art, the invention is according to the object of specifying a textile layered construction with which a higher thermal insulation can be achieved over the lifetime of the product compared to the prior art. Furthermore, it is an object to produce articles of clothing, such as a jacket or coat, in particular an insulation garment, from appropriately manufactured layered constructions with a higher thermal insulation compared to the prior art with good water vapour permeability.

According to the invention, this object is achieved for a textile layered construction with a textile outer layer and a textile inner layer, whereby line-shaped connections between the outer layer and the inner layer are designed as a welded joint, so that chambers fillable with insulating material are formed between the welded joints, by providing an absorbing component within the textile layered construction, whereby the line-shaped connections between the outer layer, the inner layer and the absorber are designed as a laser welded joint. The absorbing component can be an absorber which is arranged between the textile outer layer and the textile inner layer and/or which is integrated into at least one of the textile outer layer and the textile inner layer.

By providing welded joints, the textile construct has welded seams which, unlike traditional quilting seams, have no needle puncture holes, thus reducing the escape of insulation material such as down loss and the penetration of moisture into the interior of the textile layered construct, which improves the durability of an insulation jacket made from such textile layered constructs. At the same time, the welding process allows a completely free course of the chambers that can be filled with insulation material, so that the distribution of insulation material in the chambers, which also defines the heat retention, can be predetermined.

The laser welded joint can have a width of 0.1 up to 10 millimeters. When applying the welding to chamber seams for insulation jackets, 0.3 to 3 millimeters are advantageous. It can be performed by applying laser radiation to the layered structure from the inner or outer layer. In this case, the corresponding layer is only thin, as it is intended for the garment, since this layer is fused with the absorber, but the absorber provides the necessary material. This must not only be the material of the absorber itself, but also the materials adjacent to the absorber provide the material required for the welding seam. In particular, it is transparent, since the corresponding energy of the laser beam penetrates this layer and heats the absorber area, joining the inner layer and the outer layer together by fusion. In particular, the absorber layer is heated and the material of the absorber layer is used for welding in the joining zone.

Pressure is applied between the top layer and the bottom layer to press the respective layers together and hold them together. The laser head emitting the laser light can consist of an air-bearing glass ball, which thus combines two functions simultaneously: focusing the laser beam on the one hand and exerting mechanical pressure on the other.

Advantageously, the absorber is from the group consisting of a continuous loose interlayer, a discontinuous loose interlayer, a continuous interlayer bonded to the inner layer or the outer layer, a discontinuous interlayer bonded to the inner layer or the outer layer, or a coating applied to the inside of the inner layer or the inside of the outer layer. Furthermore, absorbent properties may be integrated directly into the inner or outer layer.

For a waterproof textile product, the outer layer may consist of two joined layers comprising an outer component and an inner component, the inner component being a weatherproof membrane or a weatherproof coating on the inside of the outer component. By "inside" is meant here facing the body. In the present case, the component is also arranged facing the center of the chamber and is therefore to be understood as facing the inside of the chamber.

At least one of the line-shaped connections may have an end provided at a distance from the edge of the textile layer structure. This means that the weld lines end before the edge of a cut piece from the layered construction by setting the laser down accordingly. Optionally, at least two line-shaped connections then have an interruption, which are located between the ends assigned to them. In other words, it is possible for a laser weld to end a weld seam and resume it at a distance of 0.1 to several centimeters. It is possible to provide such interruptions for any kind of these weld line connections, i.e. weld line connections which are reaching until an cutting edge or cutting line of a cut part, or connections which end far away from the cutting line of a cut part of reaching until a seam line and provide for a seam allowance without a weld line connection to the edge.

The at least one end of the line-shaped connections can take on many different shapes, for example from the group consisting of a straight weld seam end, a round weld seam end, a hook-shaped weld seam end, a turning weld seam end. A round weld seam also means the option to design a full circle or ellipse as the end.

For a garment detail such as a buttonhole or a zipper, a wide welding strip can be provided in the layered construction, which is cut open essentially in the middle, leaving a corresponding edge at both longitudinal ends of the welding strip, which corresponds, for example, to half the width of the welding strip. 6. A wide welding strip can also be provided for a side edge portion of the textile layered construction in the case of a textile layered construction to be used in connected with a weatherproof garment.

A cut piece, in particular for a waterproof garment, consists of a textile layered construction having at least one side edge, wherein all line-shaped connections of at least one side edge end at least at a distance from the edge of the cut piece defining a seam line, so that the outer layer and the inner layer as well as optionally an absorber forming a loose intermediate layer form a circumferential free edge end of the cut piece.

A cut-piece can be round having only one (circumferential) side edge providing the cutting line.

The cut piece can also have more than one side edge, as a e.g. the cut pieces of FIGS. 12 and 17 having four edges.

Preferredly, for at least one side edge, all line-shaped connections end at least at a distance from the edge of the cut piece defining a seam line, so that the outer layer and the inner layer as well as, if necessary, an absorber forming a loose intermediate layer form a circumferential free edge end of the cut piece. Then two of these cut pieces can be easily joined together in a watertight construction.

For non-watertight construction seams, the chamber weld seam can extend to the edge of the cut piece. For watertight construction seam there are two possibilities:

1) The chamber weld seam stops before the edge of the cut piece, so that this edge can be sealed with a seam tape between the material layers as mentioned above.

2) The edge of the cut piece consists of a wide welding strip. Then it can be sewn through the flat multilayer composite—similar to the zipper solution explained later. The sewing seam is then sealed on the inside of the inner layer with seam tape. With this variant, however, the pattern piece must be filled from another side of the pattern piece. Due to the down filling, not all sides of the pattern piece can be equipped with a wide welding strip.

However, the solution according to 2) allows to extend the chamber weld seam to the edge of the cut piece at a number of side. At least one side must be left with an opening for filling. Therefore, this side is preferredly at a side, where no chamber weld seam is predetermined to reach until the edge of the cut piece. In other words, one or more side edges of the cut piece consist of a wide welding strip. with the proviso that at least one side edge is free of a wide welding strip.

A method for producing a garment from at least two cut pieces, in particular for a waterproof garment, comprising the steps of making a construction seam between the adjacent edges of the waterproof outer layer of two cut pieces by sewing, waterproof sealing the construction seam by means of an internally applied seam tape, sewing the inner layer and, if necessary, the loose intermediate layer of the two cut pieces, and binding the sewn inner layer with a binding tape.

For incorporating a garment detail such as a buttonhole or zipper into a textile layered construction, a method may be used that includes the steps of cutting the wide weld strip substantially in the middle lengthwise along the length so as to leave at least one edge corresponding to half the width of the wide weld strip, sewing the edges of a buttonhole or sewing the sides of a zipper in the edges of the cut wide welding strip, and applying a seam tape on said edges of the cut wide welding strip on the side of the inner layer up to the area of the inner layer.

Other embodiments are specified in the dependent claims.

BRIEF DESCRIPTION OF THE DRAWINGS

Preferred embodiments of the invention are described in the following on the basis of the drawings, which serve only for explanation and are not to be interpreted restrictively. The drawings are.

DESCRIPTION OF THE INVENTION

The description of embodiments of layered constructions focuses on two construction types in layered construction and shows the variants in the insertion of the absorber. The layered constructions are advantageously applicable especially as components for the production of insulation jackets.

Figure 1:
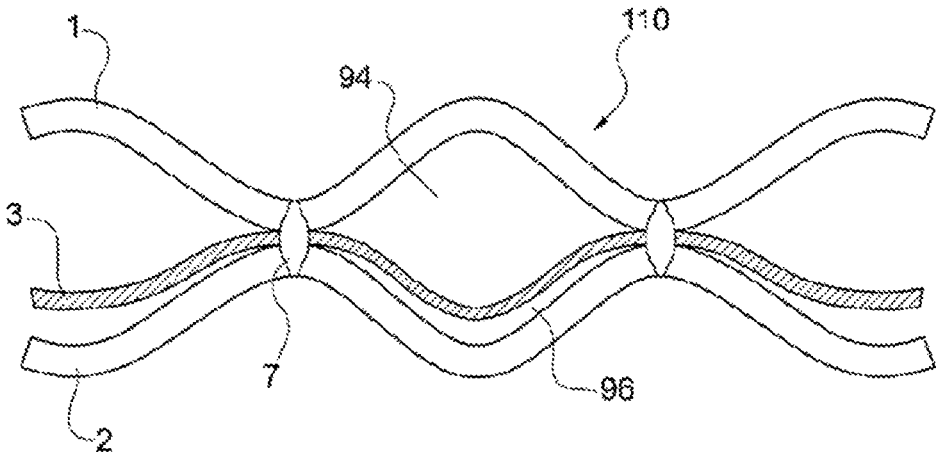
FIG. 1 shows a schematic cross-sectional view of a non-watertight layered construction according to an embodiment of the invention.

FIG. 1 shows a schematic cross-sectional view of a non-watertight layered construction 110. Further non-watertight layered constructions 120, 130, 140, 150 and 160 are shown in FIGS. 2, 3, 4, 5 and 6. The non-waterproof layered constructions 110, 120, 130, 140, 150 and 160 are characterized by the fact that no weather protection membrane 10 or weather protection coating is in the layered construction. Outer layers 1 and inner layers 2 are comparable to the structure of layered constructions of known insulation clothing. The outer layers 1 and inner layers 2 are especially fabric panels.

Laser welding of seams instead of sewing quilting seams of layer constructions 110, 120, 130, 140, 150 and 160 of insulation garments has the following technical advantages: unlike traditional quilting seams, welding seams 15 do not have needle puncture holes, which reduces the escape of insulation material (e.g. down loss) and the penetration of moisture into the inside of the insulation jacket. At the same time, the welding process allows a completely free course of the insulation chambers 94, 95 or 96, as they are called in the drawings. The shape of the chambers and thus the distribution of an insulation material 27 placed in the insulation chambers 94, 95 or 96 over the garment (and correspondingly the heat retention) can thus be freely designed. In FIGS. 1 to 11, the insulation chambers 94, 95 and 96 are shown without contents, i.e. with an air filling. When producing the layered construction, this corresponds to the step prior to filling with the corresponding insulation material 27.

Figure 2:
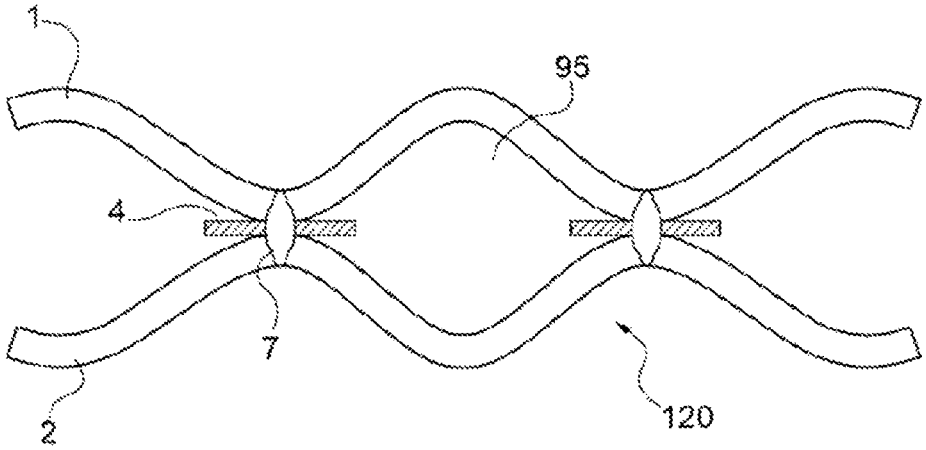
FIG. 2 shows a schematic cross-sectional view of a further non-watertight layer construction according to an embodiment of the invention.
Figure 3:
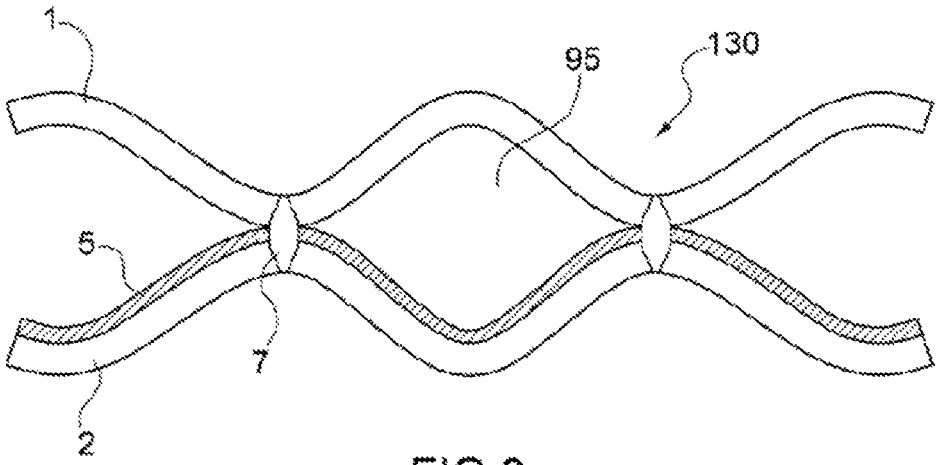
FIG. 3 shows a schematic cross-sectional view of a further non-watertight layer construction according to an embodiment of the invention.
Figure 4:
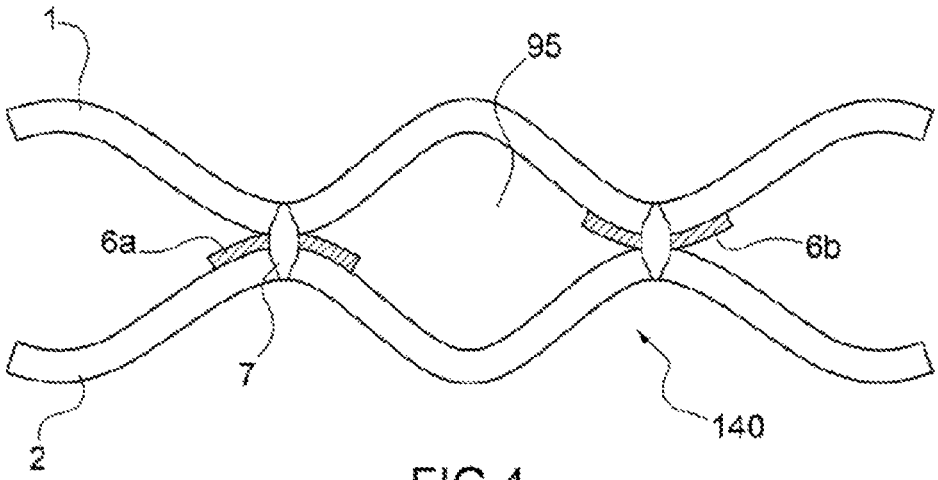
FIG. 4 shows a schematic cross-sectional view of a further non-watertight layer construction according to an embodiment of the invention.

When building up the layers, a laser light absorbing component is required, according to FIG. 1 the continuous loose intermediate layer 3. This continuous loose intermediate layer 3 represents an absorber and can be inserted either loosely as shown here in FIG. 1 or in a layer composite as shown in FIG. 3. Loose, the absorber 3 can be used as an absorber membrane or membrane with absorbing properties. In the composite as described in connection with FIG. 3, the absorber 5 can be inserted as a pressure, coating or laminated membrane or integrated into the inner or outer layer. The intermediate layer 3 or 5 can be inserted continuously as shown in FIG. 1 or FIG. 3 or discontinuously as with the intermediate layers 4 or 6*a* and 6*b* as shown in FIG. 2 or FIG. 4. A laser light absorbing component is required for welding the textile layer construction. In addition, all layers to be joined must be made of thermoplastics compatible with welding. Under the influence of focused laser light, thermal energy is generated in the absorbing component. During the welding process, the laser light penetrates through the outer layer 1 or inner layer 2 and is stopped and absorbed in the component with absorbing properties. The resulting thermal energy causes the melting of the thermoplastic polymer of the absorbing and adjacent layers. Under the effect of a mechanical pressure, the adjacent layers fuse with the absorbing component and form a joining zone 7, so that a connection without holes in the layers is realized.

The outer layer 1 can be realized as an outer fabric panel. The inner layer 2 can be realized as an inner fabric panel. Instead of inserting an absorbent intermediate layer into the textile layered construction, absorbent properties can also be integrated directly into a fabric panel. The outer layer 1 thus becomes an outer layer with absorbing properties 1*a* or the inner layer 2 becomes an inner layer with absorbing properties 2*a*. By dyeing the textile yarn or the textile fabric with colors in the light frequency range visible to the laser, absorbing properties can be integrated directly into the textile itself.

During welding, the layers of material are laid flat on the laser machine, not gathered. The volume of the chambers is only created by filling them with insulating material.

Without a continuous loose intermediate layer, insulation chambers 95 are formed between the outer layer and the inner layer for filling with insulation material 27. In the case of the continuous loose intermediate layer 3, the insulation chambers located essentially above and below the drawing plane are divided into an outer insulation chamber 94 and an inner insulation chamber 96. Through this separation, there is no exchange of filling material 27 between chambers 94 and 96.

In FIG. 2, on the other hand, which shows a non-waterproof layered structure 120, tapes are provided as discontinuous absorbent intermediate layers. The tapes 4, which are shown here in cross-section, run above and below the drawing plane in the simplest embodiment perpendicular to the drawing plane and meander in other designs if the weld seams 15 in the joining zone 7 are not aligned straight.

FIG. 3 and FIG. 4 show layer constructions 130 and 140, where a continuous connected intermediate layer 5 or discontinuous connected intermediate layers are provided. This means that the intermediate layer 5 is fixed and cannot be easily separated from the inner layer 2 or the outer layer 1. In FIG. 3, the intermediate layer 5 is firmly connected to the inner layer 2. In other embodiments, it can also be connected to the outer layer 1. Instead of an absorbent membrane, the layer can also be provided as an absorbent printed layer. This applies in particular to the layered construct 140, where on the inward side of the outer layer 1 and on the outward side of the inner layer 2, the discontinuously connected intermediate layer 6*a* or 6*b* of the layered construct 140 are alternatively provided. The absorber can either be applied to the bottom side of the outer layer 1, which is the inside of the outer layer 1, or to the top side of the inner layer 2, which is the outside of the inner layer 2. Both variants, which are to be understood as alternatives, are combined here in one drawing; the drawing should not give the impression that the absorber is alternately applied on top and bottom.

Figure 5:
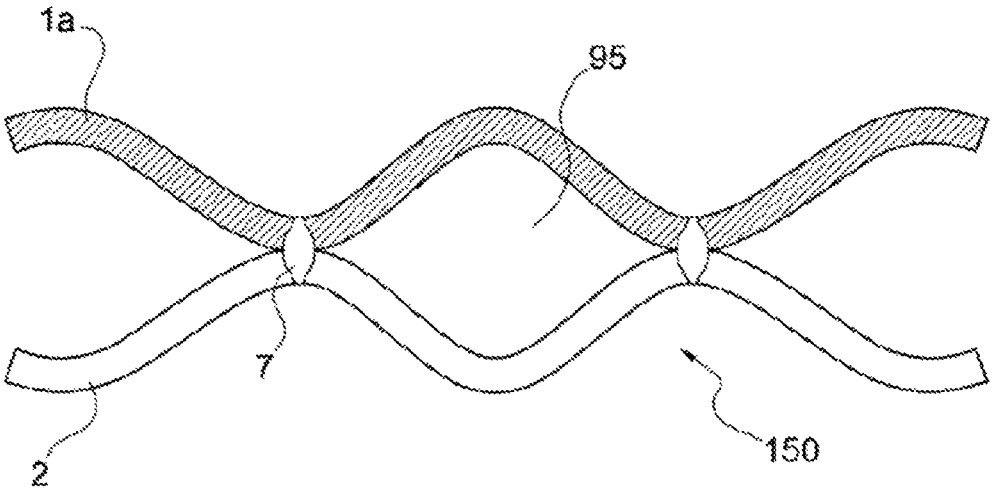
FIG. 5 shows a schematic cross-sectional view of a further non-watertight layer construction according to an embodiment of the invention.
Figure 6:
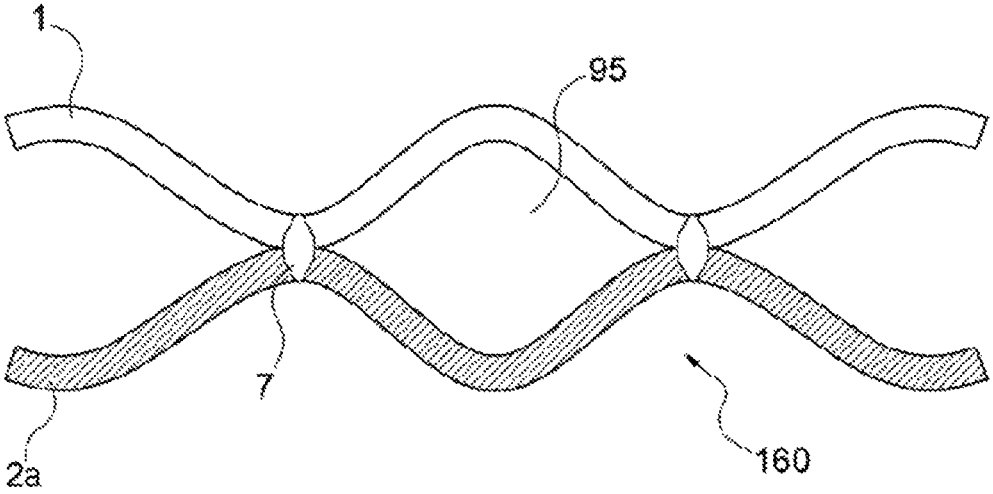
FIG. 6 shows a schematic cross-sectional view of a further non-watertight layer construction according to an embodiment of the invention.
Figure 7:
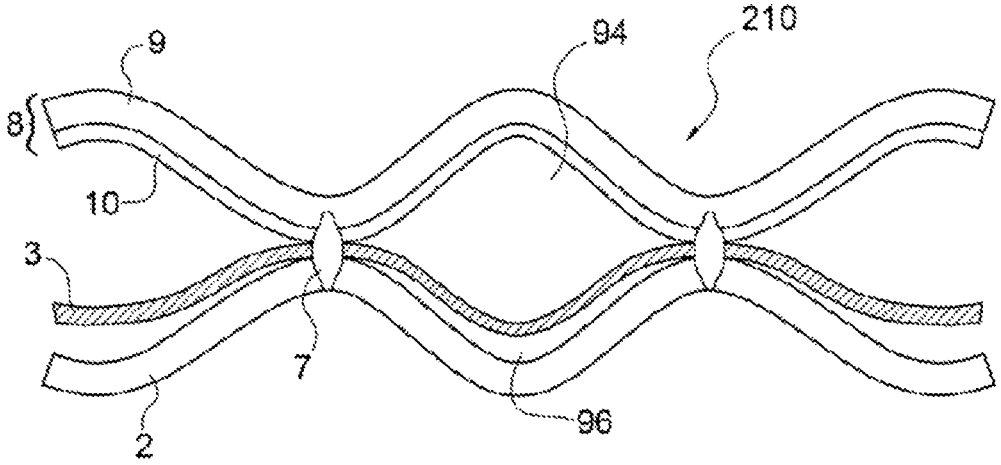
FIG. 7 shows a schematic cross-sectional view of a watertight layered construction according to an embodiment of the invention.
Figure 8:
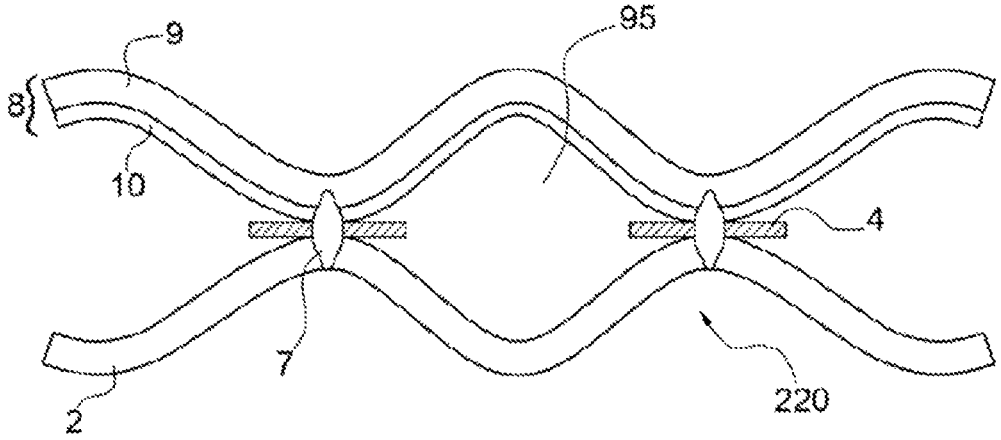
FIG. 8 shows a schematic cross-sectional view of another watertight layer construction according to an embodiment of the invention.
Figure 9:
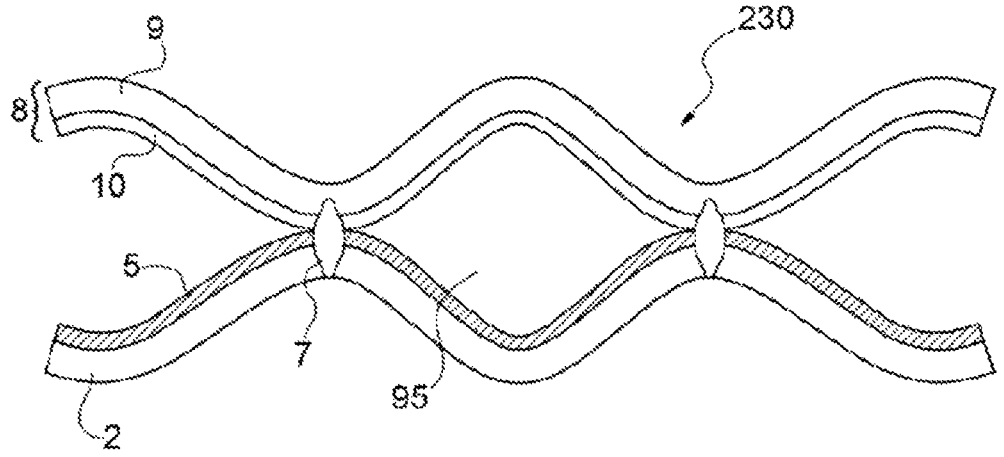
FIG. 9 shows a schematic cross-sectional view of another watertight layer construction according to an embodiment of the invention.
Figure 10:
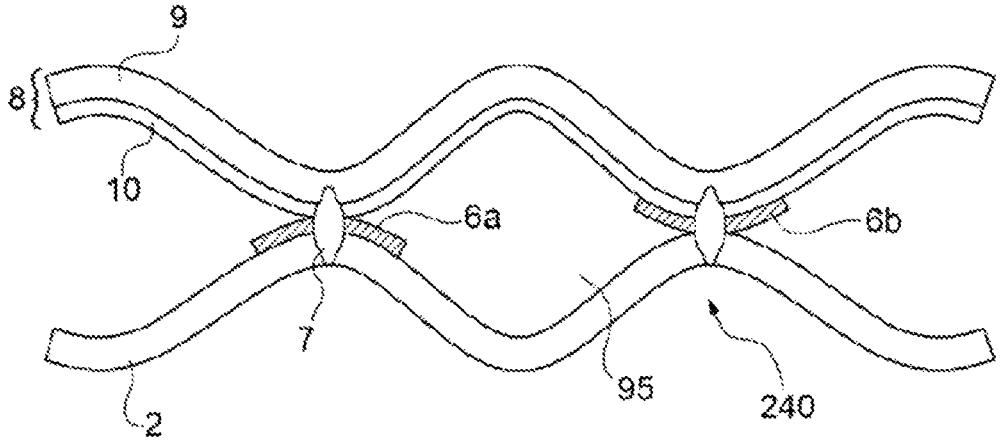
FIG. 10 shows a schematic cross-sectional view of another watertight layer construction according to an embodiment of the invention.
Figure 11:
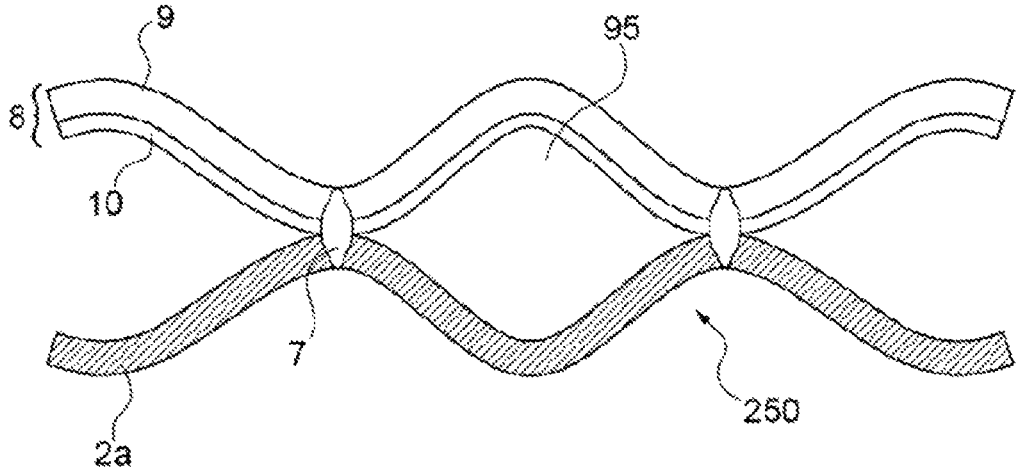
FIG. 11 shows a schematic cross-sectional view of another watertight layer construction according to an embodiment of the invention.

FIG. 5 and FIG. 6 show layer constructions 150 and 160, in which an absorbing component, i.e. an absorber, is provided in the outer layer 1*a* and in the inner layer 2*a*, respectively. The coloring of the textile yarn or the textile fabric with colors in the light frequency range visible to the laser can be complete or it can be provided only in certain areas.

FIGS. 7, 8, 9, 10 and 11 each show a schematic cross-sectional view of a watertight layered construction 210, 220, 230, 240 and 250, respectively, according to an embodiment of the invention. The same features are marked with the same reference signs in different embodiments and drawings.

The waterproof construction according to FIGS. 7 to 11 is characterized by the fact that a weather protection membrane or coating is located in the layer structure. The outer layer 1 of FIGS. 1 to 4 and 6 has been replaced in the respective waterproof variants by a layer construction 8 as the waterproof outer layer. This waterproof outer layer 8 comprises an outer component 9 and an inner component 10, the outer component 9 being, for example, the fabric as shown in FIGS. 1 to 4 and 6, and the inner component 10 being an independent weather protection membrane or a weather protection coating on the inside of the outer component 9.

As with the non-waterproof construction according to FIGS. 1 to 6, the welding process allows a completely free course of the insulation chambers 94, 95, 96. The combination of waterproof weather protection and completely free course of the quilting or welding seam is a clear technical differentiation from sewing according to the prior art.

In the case of the watertight construction, the same options are available with the layer constructions 210, 220, 230, 240, 250 as already described for the layer constructions 110, 120, 130, 140, 150, 160 to insert an absorbent component as an intermediate layer 3, 4, 5, 6*a*, 6*b*, or as an inner layer 2*b*.

The insulation material 27, which can be filled into the insulation chambers 94, 95, 96, can basically be used either in loose form or in the form of a continuous padding. This concerns well-known basic materials such as down (usually in loose form, but also available as padding) and synthetic fiber fillings (usually in the form of padding, but also available in loose form). The construction of quilted chambers 94, 95 and 96 is primarily common for loose insulation materials. Such loose insulation materials are blown into insulation chambers 94, 95 and 96 after welding. In the embodiments with a continuous loose interlayer 3 as absorber, the insulation material 27 can be inserted both above and below the absorber membrane 3.

For a material-locking connection, all components to be joined must be made of thermoplastic materials that are compatible with welding technology. This requires a similar chemical composition and similar melting points of the polymers of intermediate layer 3 or 6*a*, 6*b* and outer layer 1, 1*a* or 8 and inner layer 2, 2*a*.

For the outer or inner layer, you can use fabric panels which are commercially available polyester fabrics with a basis weight of approx. 50-100 g/m$^2$ and a yarn weight of approx. 20-100 den. However, the weight per unit area and yarn weight can be selected differently.

In the waterproof application and in the embodiments shown in FIGS. 7 to 11, this outer layer 8 can be constructed from two components 9 and 10: a textile layer, referred to above as fabric sheet 9 on the outside, and a weather protection membrane or coating 10 on the inside.

The weather protection membrane is characterized by the fact that it is waterproof and at the same time permeable to water vapor. The minimum requirements for a waterproof textile laminate that are common in practice are a water column (water pressure resistance) of at least 10,000 mm (=1.0 bar) measured according to DIN EN 20811. The minimum requirements for a water vapor permeable textile laminate that are common in practice are a water vapor transmission resistance of at most 20 m$^2$Pa/W measured according to ISO 11092. The thickness of common weather protection membranes is in the range of 10-30 μm.

As an example of an absorber, reference can be made to prior art designs as disclosed in EP 3 155 933 A1, in particular paragraphs [0022-0023] on page 4.

A diode laser can be used as a laser, in particular the applicant has used a diode laser with an energy range of up to 40 W. The process used is called laser transmission welding. Corresponding explanations can be found in the state of the art, for example in EP 3 155 933 A1 in paragraphs or [0025-0028].

To minimize the cold bridges between laterally adjacent insulation chambers 94, 95 and 96, it is advantageous if the laser seam 15 in joining zone 7 is as narrow as possible. On the other hand, a wider weld seam 15 has higher tensile strength values. A welding width of 0.5 mm to 3.0 mm has proven to be effective.

In addition to laser welding, ultrasonic welding and high-frequency welding can also be used. The advantage of laser welding is that the heat energy is generated from the absorbing component 1*a*, 2*a*, 3, 6*a*, 6*b*. There is no damage to the inner layer 1 or the outer layer 2 or 8. When a laser is applied to the fabric, the energy can be applied in a very dosed and precisely controlled manner so that very thin waterproof and vapour-permeable membranes can be welded, which would be too delicate for the other welding methods mentioned. Here we refer again to the state of the art according to EP 3 155 933 A1 and there to paragraph [0003].

Figure 12:
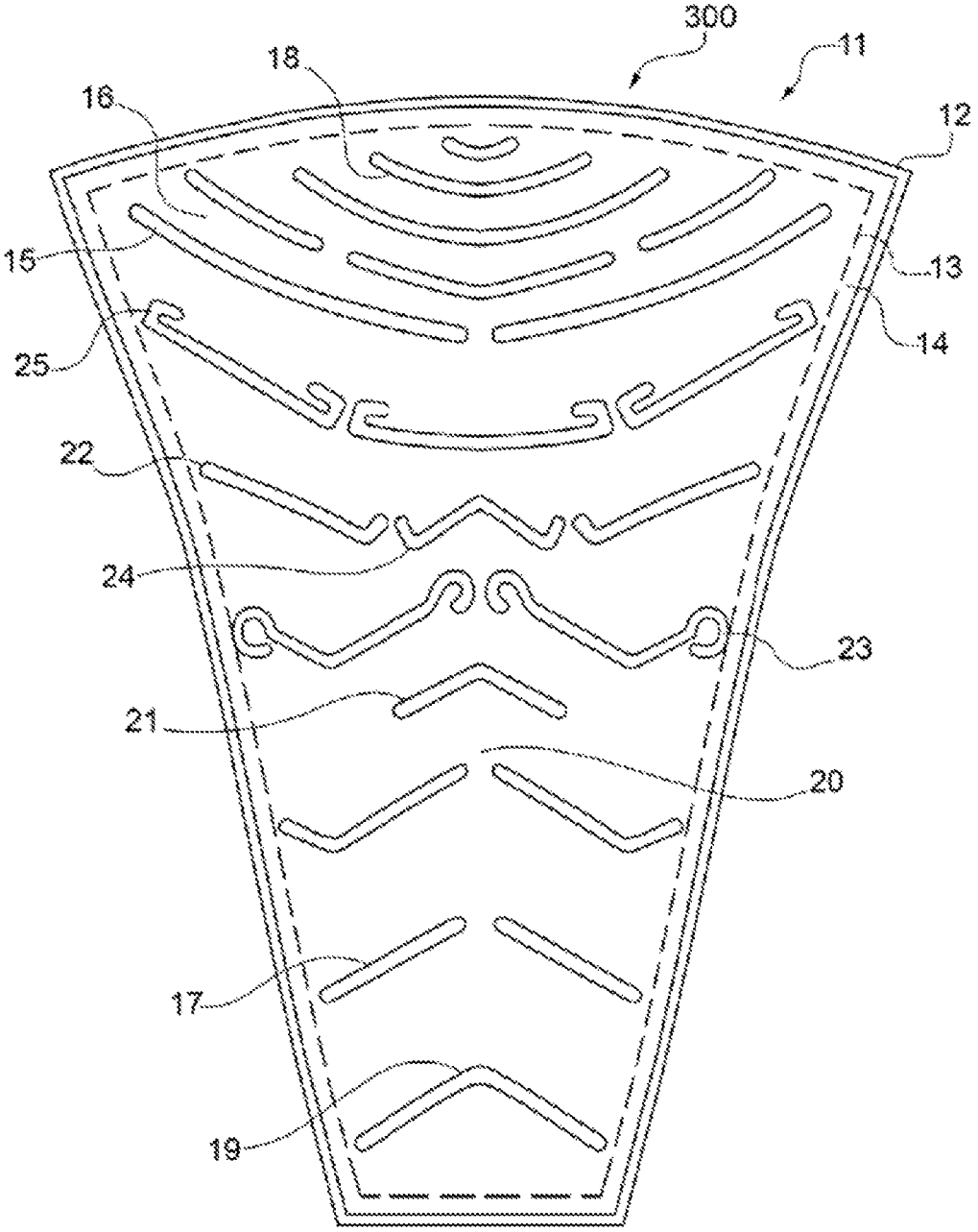
FIG. 12 shows a schematic illustration of a cut section and weld seams according to an embodiment of the invention.
Figure 17:
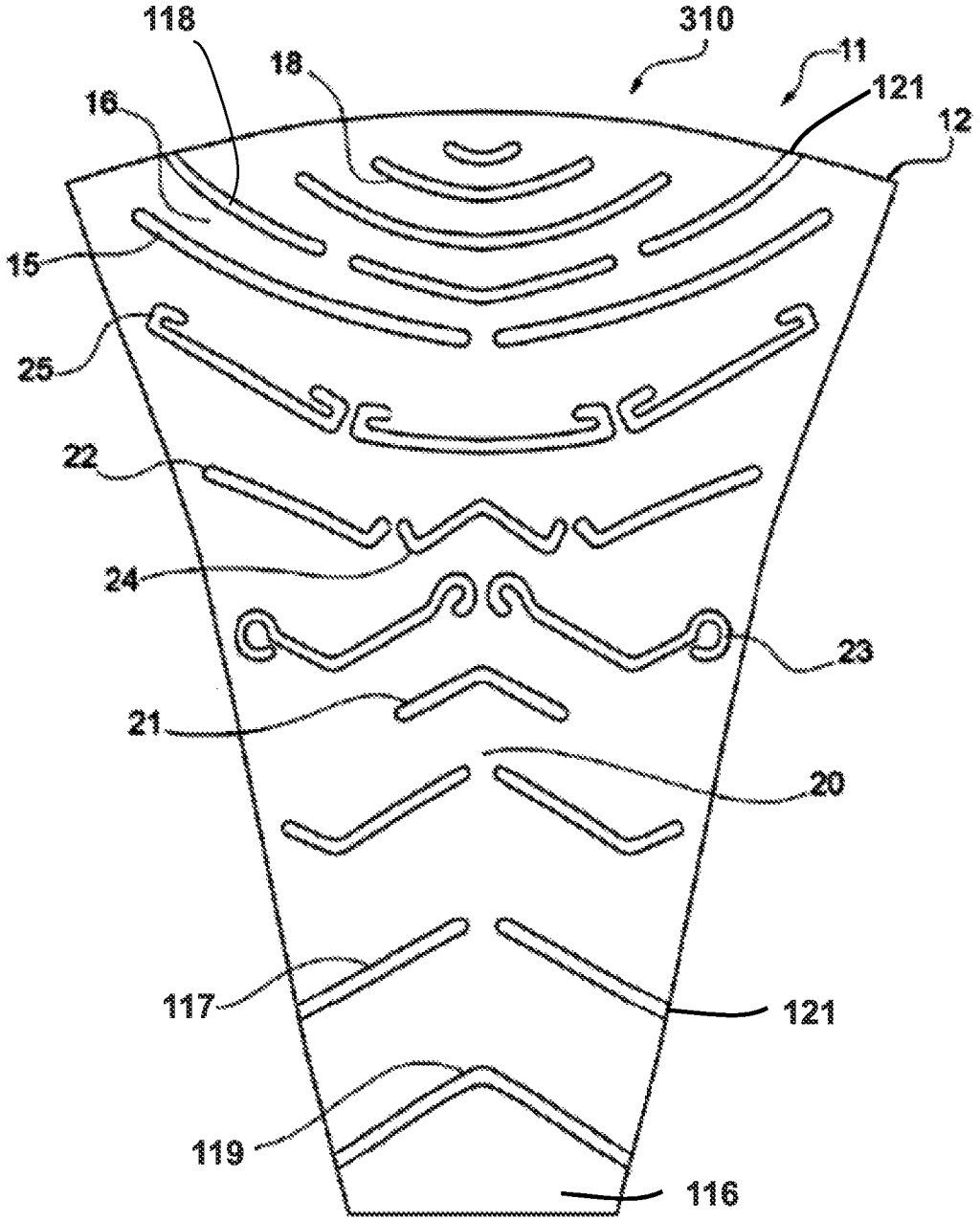
FIG. 17 shows a schematic illustration of a cut section and weld seams according to a further embodiment of the invention.

In addition to the advantages of laser welding for the layer structure 110, 120, 130, 140, 150, 150, 160, 210, 220, 230, 240, 250 as such, new shapes and designs of insulation chambers 16, 94, 95, 96 are possible, which are explained in connection with FIG. 12 and FIG. 17. FIG. 12 shows a schematic plan view of a cut part 300 and weld seam sequences according to an embodiment of the invention. The embodiment shown in FIG. 12 can be especially used for a watertight construction seam but can of course also be used in connection with non-watertight construction seams. FIG. 17 shows a schematic plan view of a cut part 310 and weld seam sequences according to a further embodiment of the invention. The embodiment shown in FIG. 12 can be especially used for a non-watertight construction seam, since some of the weld lines go until the cut edge, but it can also be used in connection with watertight construction seams with the proviso that a seam line 13 providing for a seam allowance 14 for a then later watertight construction of the connection with an adjoining cut part is present at at least one of the here four sides and there is a path for filling or insulation material 27 from that side to any insulation chamber 16 section.

By welding the materials, the aforementioned insulation chambers 16, 94, 95, 96 are created within the pattern piece or cut part 300. The weld seams 15, here in the plan view of the pattern piece 300, i.e. representing the uppermost part of the respective joining zone 7, form the lateral boundaries of the insulation chambers, here marked 16, which exist below the flat areas between the weld seams 15. The user of the invention described here has a high degree of design freedom with respect to the course of the weld seams 15 as long as a path exists to fill the insulation chambers 16. For this purpose, each area within an insulation chamber must be accessible for the filling material from one edge of the cutting section 300. The distance between parallel weld seams 15 should preferably be at least 1.5 cm, better 2.5 cm, so that the filling material 27 can be distributed well in the insulation chambers 16.

The individual isolation chambers 16 can be designed continuous or interrupted. The interruption 20 of the welding lines 15 improves the drapability of the design of the pattern piece 300. The welding lines can run parallel, offset and overlapping, as the welding seams 21 overlapping to form a "V" do.

The end of the welding lines can either be straight as a straight weld 17 and end as a straight end 22, or be designed by geometric shapes to improve the strength of the weld and minimize slippage of the insulation material. Possibilities are, for example, a round end 23, a hook-shaped end 24, or a turning end 25 of the weld seam 15, plus curved weld seams 18, which can also have interruptions 20.

A continuous seam line 13 is drawn as a dashed curve at a distance from the edge of the pattern piece or cut part. In this context, seam line means that, if the garment is not waterproof, e.g., according to layered constructions according to FIGS. 1 to 6, the welding seams 15 can reach up to cutting line 12 of the cut-piece 300. For waterproof constructions, the welding seams 15 usually should not extend beyond seam line 13 so that the individual material layers remain separated in the area of the seam allowance for sealing the construction seams, as explained below in connection with FIG. 13.

The above description applies in general also to FIG. 17 with the difference that the cut-part has the reference numeral 310. A seam line 13 is not provided. Some of the weld lines end at the cut part edge 121, i.e. at the cutting line 12, as weld lines 117, 118 and 119. Straight welding seam 117 has an interruption 20 of the welding seam in the middle so that filling material 27 can still be filled from above, even if the sides at the cutting line 12 would be a continuous seam line. This will not happen for the insulation chamber 116 below angular welding seam 119 since it is running from one cut part edge to the cut part edge on the opposite side. The weld lines ending at the cut part edge 121 can also be at the top or (here not shown) bottom edge of cut part 310. Here the two curved welding seam lines are reaching until the end.

Therefore, in case of watertight construction seams, the chamber weld seam can extend in some parts to the edge of the cut piece. The edge of the cut piece can consist of a wide welding strip. Then it can be sewn through the flat multilayer composite—similar to the zipper solution explained later. The sewing seam is then sealed on the inside of the inner layer with seam tape. With this variant, however, the pattern piece must be filled from another side of the pattern piece. Due to the down filling, not all sides of the pattern piece can be equipped with a wide welding strip.

Figure 13:
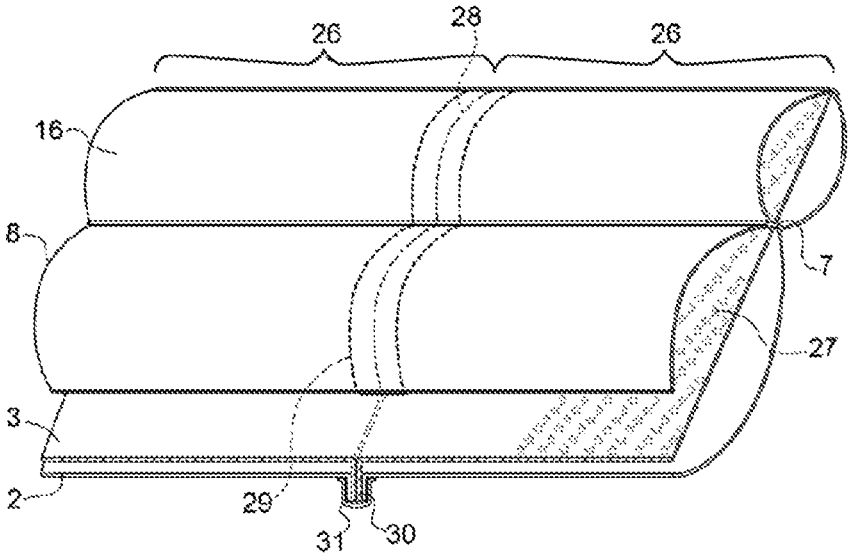
FIG. 13 shows a perspective view of sections of two cut parts placed next to each other for their connection according to a method according to an embodiment of the invention.

A garment such as an insulation jacket is made by joining, for example, layered constructions 110 or 210 welded cut parts 300 or 310. FIG. 13 shows a perspective view of two cut parts 26 of two adjacent pattern pieces or cut parts 300 to be joined together by a process according to an embodiment of the invention. In the case of the non-watertight construction with layered constructions 110, this can be done in a known manner, e.g. by sewing and binding the fabric on the inside, followed by trimming the excess material with a binding tape. The same would apply in cases of cut parts 310.

In the case of the watertight construction with layered constructions 210, which form the cut-outs or cut parts 26, the present invention provides a novel process solution: First, the watertight outer layer 8 of two cut-outs 210 is sewn together. The result is a central construction seam 28 between the adjacent cut-outs 26 of the pattern pieces 300, which is shown as a dashed line. In the next step, construction seam 28 is sealed watertight with the aid of a seam tape 29, which is shown as a transparent line on the central construction seam 28. The seam tape 29 is applied to the inside of the waterproof outer layer 8, especially glued or welded with hot air. Finally, the intermediate layer 3 and the inner layer 2 are sewn underneath the outer layer 8 and the construction seam 28, which is covered by the seam tape 29 on the inside, bordered and finished off with the aid of a border tape 31, the border tape 31 forming a "U" on the inside and enclosing the intermediate layer 3 and the inner layer 2 in between.

This allows an insulating garment to be made waterproof without water penetrating through seams into the interior. To complete a manufacturing process of laser-welded garments, process solutions for garment details such as a zipper or a pocket closure must also be specified. The manufacturing process of the garment requires that first the layers of material used are welded together and only in the second step is the garment further processed. This is no disadvantage for non-waterproof processing, which is the conventional way of producing insulation garments. For waterproof processing, however, the difficulty is that the end result must be a waterproof seal for all processing solutions and the materials to be processed must always be handled as a layered composite after welding. This layer bonding makes it difficult to insert garment details such as a pocket zipper 36 waterproof into a cut piece 11.

A possible solution is to use the zipper 36 in the same way as the connection of two cut pieces, as shown in FIG. 13. In this case, the zipper 36 is sewn to the outer layer 8. This seam must then be sealed on the inside using seam tape. As a third step, the still loose intermediate layer 3 and the inner layer 2 must be serged with another seam tape. Since this is done in the middle of a pattern piece and not at the edge of a pattern piece as when assembling the cut out parts 26 according to FIG. 13, the handling of the materials is much more delicate and complex, which has an influence on the manufacturing costs of the end product.

An alternative solution, which is less complicated to process, is to seal the seam on the inside of the inner layer. However, if several layers of fabric lying one on top of the other are not joined flat in the area of a sewing seam, attaching a seam tape would not prevent water from penetrating through the needle puncture holes of the sewing seam, since the water can penetrate between the layers into the inside of the chambers. Therefore, according to one design example of the invention, a wide welding strip 33 is produced by means of the laser in the area of the zipper. In this welding strip 33, all layers of material are firmly joined together. In case of a sewing seam within this welding strip, water cannot penetrate between the individual layers. Attaching a seam tape only on the inside of the inner layer is sufficient to seal the entire layer composite. Processing solutions for clothing technology can thus be simplified considerably.

Figure 14:
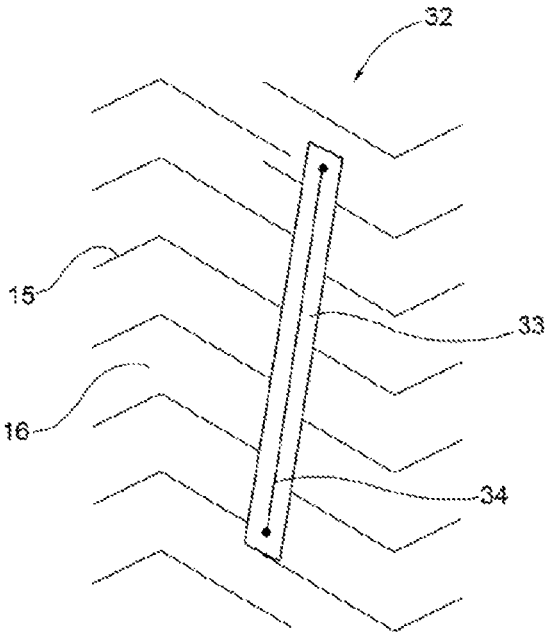
FIG. 14 shows a schematic top view of a cut piece with a plurality of offset and interrupted welds with a space for a zipper.
Figure 15:
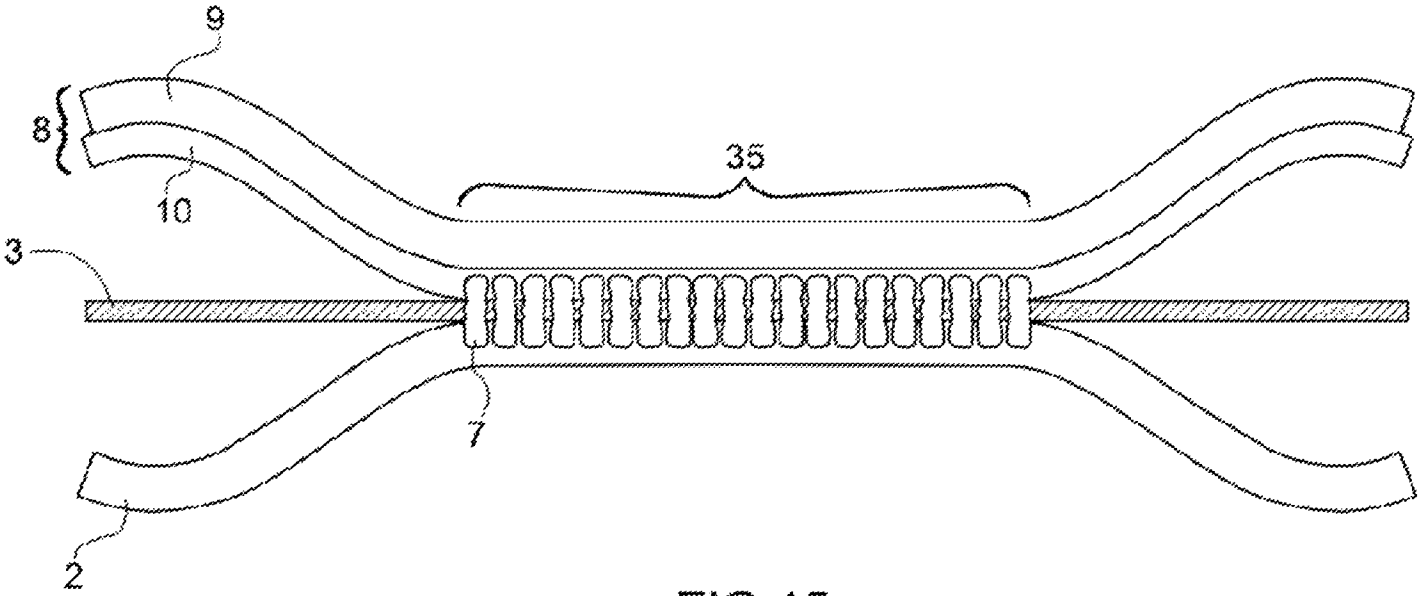
FIG. 15 shows a schematic cross-section of the multilayer composite with zipper and seam tape across the weld strip as shown in FIG. 11.
Figure 16:
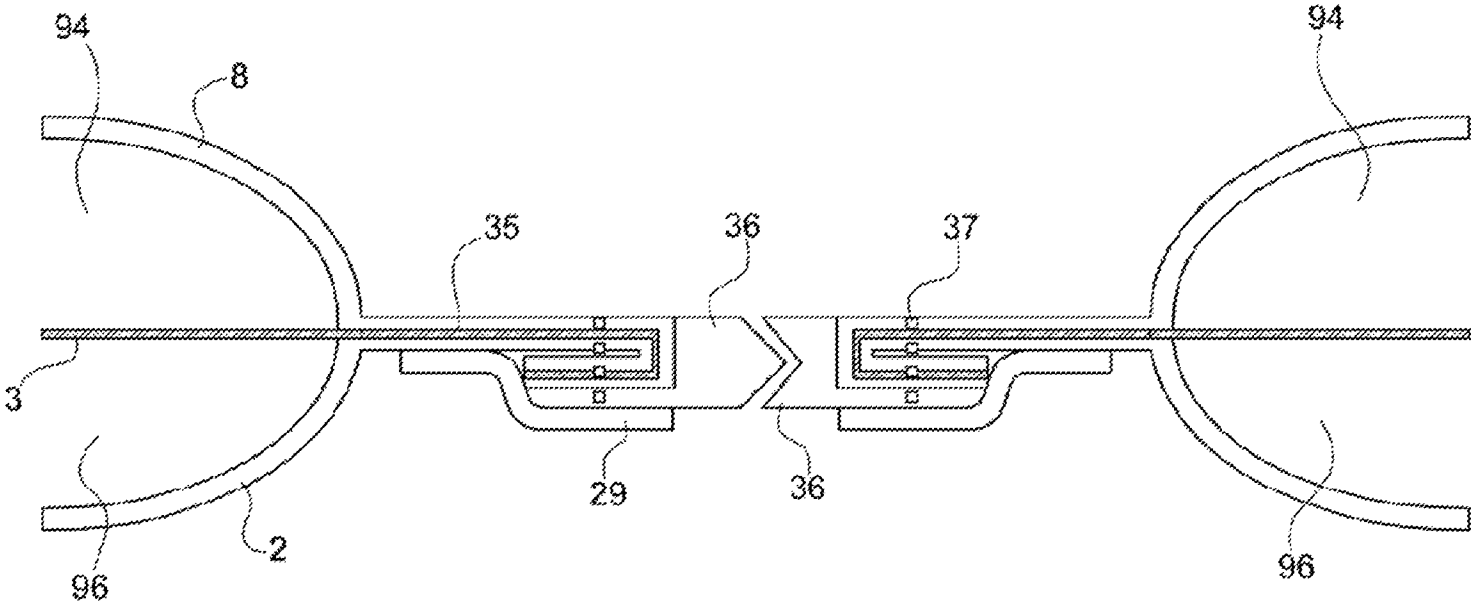
FIG. 16 shows a schematic cross-section through a zipper and seam tape after insertion into a cut piece according to FIG. 11 across the welding tape.

FIG. 14 visualizes this alternative processing solution in the form of a schematic top view of a cut piece 32 with a large number of offset and interrupted weld seams 15 and a space for a zipper 34 in a wide weld strip 33. FIG. 15 shows a schematic cross-section of the multilayer composite with joining zone across the wide weld strip. Finally FIG. 16 shows a schematic cross section through a zipper 36 and two seam tapes 29 left and right after the insertion of the zipper 36 into a cut section according to FIG. 14 across the heatsealing strip 35.

This is illustrated below using the example of a zip fastener. In the same work step in which the welding seams 15 for the insulation chambers are welded into the material layers, a wide strip 33 is welded in the area where the zipper 34 is sewn into the pattern piece 32. After welding, the situation shown in FIG. 15 results. The waterproof outer layer 8, consisting of the outer component 9 and an inner component 10, is provided with a wide welding strip over the area 35 with a correspondingly wide joining zone 7, which is fused to the inner component 10 and the inner layer 2 via the continuous intermediate layer 3. This wide joining zone 7 is built up by a large number of narrow welding lines which are welded together and thus form a wide welding strip in its entirety. This corresponds to the reference mark 33 in FIG. 14. The zipper is then inserted in the center of the welding strip 35 in such a way that the normal seam is located within the wide welded strip 33 or 35. This is illustrated in FIG. 16. On the left and right, FIG. 16 shows the insulation chambers 94, 96, through which the intermediate layer 3 passes and which are bounded on the outside and inside by the waterproof outer layer 8 and the inner layer 2. If necessary, other elements can be sewn on at the same time, e.g. underlap or pocket bag. The wide welding seam 35 then reaches up to the zipper 36. It comprises the waterproof outer layer 8 and the inner layer 2, which are pierced by the sewing seam 37. Finally, the sewing seam 37 is sealed on the inside of the inner layer 2 with a seam tape 29. Thanks to the wide welded strip 35, water penetrating into the sewing seam 37 from the outside cannot penetrate between the material layers into the inside of the chambers. This is protected from the inside by the seam tape 29 on both sides of the zipper.

The invention claimed is:

1. A textile layered construction comprising:

a textile outer layer;

a textile inner layer, an absorber, which is arranged between the textile outer layer and the textile inner layer or which is intergrated in at least one of the textile outer layer and the textile inner layer, and at least one line-shaped joint connection between the outer layer and the inner layer forming chambers fillable with insulating material on both sides of the line-shaped joint connection, wherein the line-shaped joint connection is a laser welded joint connection, and wherein at least one line-shaped welded joint connection comprises an interruption separating the line-shaped welded joint connection into two line-shaped welded joint connection parts.

2. The textile layered construction according to claim 1, wherein the absorber is at least one element from the group comprising: a continuous loose intermediate layer, a discontinuous loose intermediate layer, a continuous intermediate layer bonded to the inner layer or to the outer layer, a discontinuous intermediate layer bonded to the inner layer or the outer layer, a coating applied to the inner side of the inner layer or the inner side of the outer layer, an outer layer having integrated absorbent properties, and an inner layer having integrated absorbent properties.

3. The textile layered construction according to claim 1, wherein the outer layer consists of two bonded layers comprising an outer component and an inner component, the inner component being a weatherproof membrane or a weatherproof coating on the inside of the outer component.

4. The textile layer construction according to claim 1, wherein the at least one line-shaped welded joint connection has an end provided at a distance from the edge of the textile layered construction.

5. The textile layered construction according to claim 4, wherein the end of the line-shaped welded joint connection is selected from the group consisting of: a straight weld seam end, a round weld seam end, a hook-shaped weld seam end, and a turning weld seam end.

6. The textile layered construction according to claim 1, wherein a wide welding strip for a garment detail from the group encompassing a buttonhole, a zipper or a side edge portion of the textile layered construction is provided in the layered construction, which is, in the case of a wide welding strip for a buttonhole or a zipper, cut substantially in the middle.

7. The textile layered construction according to claim 1, wherein the insulating material is selected from the group encompassing downs and synthetic fibers.

8. A cut piece consisting of a textile layered construction having at least one side edge comprising:

a textile outer layer;

a textile inner layer, an absorber, which is arranged between the textile outer layer and the textile inner layer or which is intergrated in at least one of the textile outer layer and the textile inner layer, and at least one line-shaped joint connection between the outer layer and the inner layer forming chambers fillable with insulating material on both sides of the line-shaped joint connection, wherein the line-shaped joint connection is a laser welded joint connection, and wherein at least one line-shaped welded joint connection comprises an interruption separating the line-shaped welded joint connection into two line-shaped welded joint connection parts.

9. The cut piece according to claim 8, wherein all line-shaped connections of at least one side edge end at least at a distance from the edge of the cut piece defining a seam line, so that the outer layer and the inner layer as well as, if necessary, an absorber forming a loose intermediate layer form a circumferential free edge end of the cut piece.

10. The cut piece according to claim 8, wherein one or more side edges of the cut piece consist of a wide welding strip, and wherein at least one side edge is free of a wide welding strip.

11. The cut piece according to claim 8, wherein the insulating material is selected from the group encompassing downs and synthetic fibers.

12. A method of producing a garment from at least two cut pieces each consisting of a textile layered construction having at least one side edge comprising:

a textile waterproof outer layer;

a textile inner layer, an absorber, which is arranged between the textile waterproof outer layer and the textile inner layer or which is intergrated in at least one of the textile waterproof outer layer and the textile inner layer, and at least one line-shaped joint connection between the waterproof outer layer and the inner layer forming chambers fillable with insulating material on both sides of the line-shaped joint connection, wherein the line-shaped joint connection is a laser welded joint connection, wherein at least one line-shaped welded joint connection comprises an interruption separating the line-shaped welded joint connection into two line-shaped welded joint connection parts, and wherein the method comprises the steps of producing a construction seam between the adjacent edges of the waterproof outer layer of two cut parts by joining them, by the watertight sealing of the construction seam with the aid of an internally applied seam tape, by joining of the inner layer and by edging of the joined inner layer with an edging tape.

13. The method according to claim 12, wherein joining of the adjacent edges is executed by sewing and joining of the inner layer is executed by sewing.

14. The method according to claim 12, wherein joining of the inner layer comprises joining with the loose intermediate layer of the two cut parts.

15. A method of incorporating a garment detail from the group comprising a buttonhole or a zipper into a textile layered construction comprising:

a textile outer layer;

a textile inner layer, an absorber, which is arranged between the textile outer layer and the textile inner layer or which is intergrated in at least one of the textile outer layer and the textile inner layer, at least one line-shaped joint connection between the outer layer and the inner layer forming chambers fillable with insulating material on both sides of the line-shaped joint connection, wherein the line-shaped joint connection is a laser welded joint connection, and a wide welding strip for the garment detail, wherein the method comprises the steps of cutting the wide welding strip substantially centrally along its length, wherein the cut has a length that at least one half of the width of the wide welding strip remains uncut, sewing the edges of a buttonhole or sewing the sides of a zipper in the edges of the cut wide welding strip, and applying a seam tape to said edges of the cut wide welding strip on the side of the inner layer up to the area of the inner layer.

* * * * *